United States Patent [19]

Heinemann et al.

[11] Patent Number: 4,663,031

[45] Date of Patent: May 5, 1987

[54] PERCUSSION JIG

[75] Inventors: Otto Heinemann; Hans-Hermann Nanz; Günter Milewski, all of Ennigerloh; Norbert Schröder, Oelde, all of Fed. Rep. of Germany

[73] Assignee: Krupp Polysius AG, Beckum, Fed. Rep. of Germany

[21] Appl. No.: 825,358

[22] Filed: Feb. 3, 1986

[30] Foreign Application Priority Data

Mar. 29, 1985 [DE] Fed. Rep. of Germany ..... 3511671

[51] Int. Cl.[4] ..... B03B 5/22

[52] U.S. Cl. ..... 209/427; 209/455; 209/457; 209/488; 209/498

[58] Field of Search ..... 209/427, 425, 423, 455, 209/457, 488, 489, 493, 498, 254, 17, 268, 269, 13, 18, 240, 243, 255

[56] References Cited

U.S. PATENT DOCUMENTS

| | | | |
|---|---|---|---|
| 1,605,752 | 11/1926 | McLean et al. | 209/427 |
| 1,646,422 | 10/1927 | Reilly | 209/427 X |
| 1,728,196 | 9/1929 | Blatch | 209/427 X |
| 4,563,271 | 1/1986 | Schroder et al. | 209/427 |

*Primary Examiner*—Joseph J. Rolla
*Assistant Examiner*—David H. Bollinger
*Attorney, Agent, or Firm*—Learman & McCulloch

[57] ABSTRACT

The invention relates to a percussion jig in which the chutes for receiving and discharging the material to be separated are each divided into a plurality of individual chute segments arranged spaced from one another so that the spaces between adjacent individual chute segments facilitate a free equalization of the levels of the settling fluid during the upward and downward movements of the settling tank.

15 Claims, 2 Drawing Figures

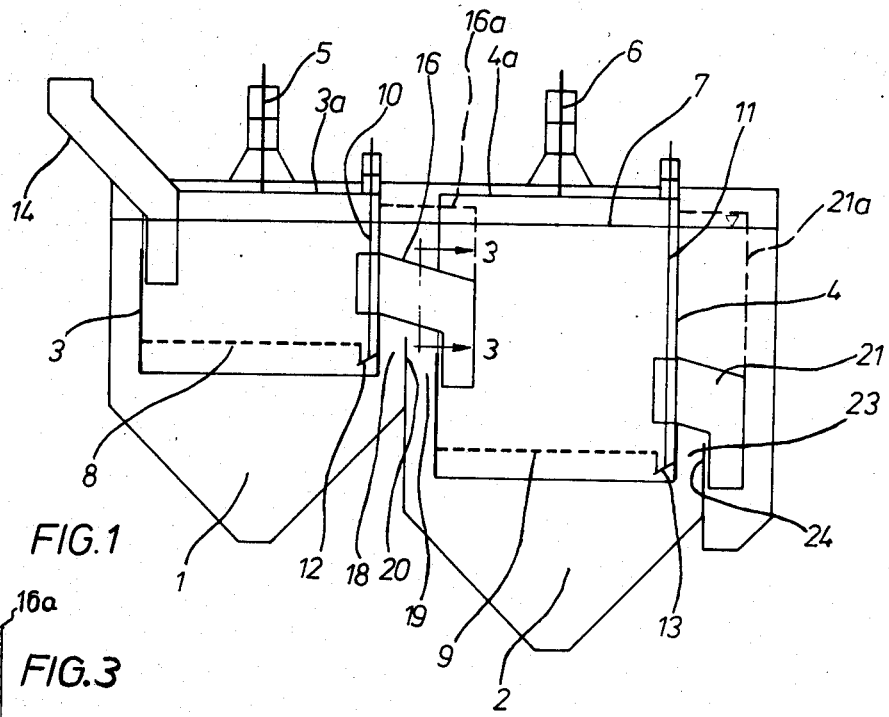
FIG.1
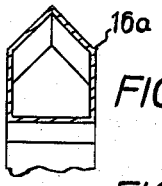
FIG.3
FIG. 2
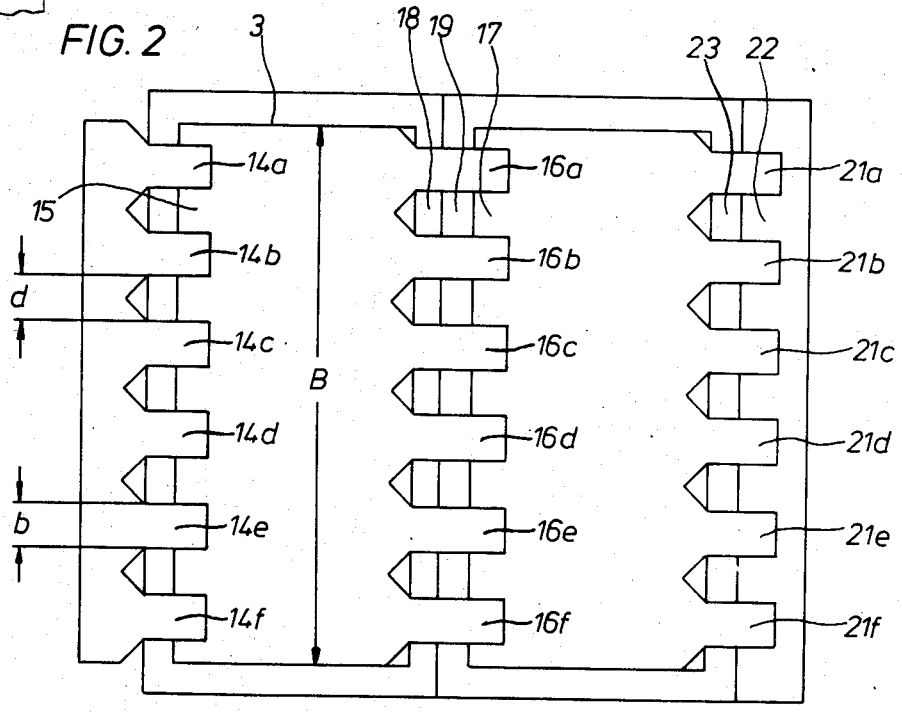

PERCUSSION JIG

The invention relates to a percussion jig having a vertically reciprocable settling tank partially immersed in a fluid contained in a tub.

BACKGROUND OF THE INVENTION

A percussion jig of the general type to which the invention relates is disclosed in the textbook by Rittinger, *Lehrbuch der Aufbereitungskunde, FIG.* 297a.

In this known percussion jig a light material discharge chute extends over the whole breadth of the settling tank and is movable upwards and downwards with the settling tank. During operation the walls of the settling tank are located below the surface of the settling fluid. Thus the chute is completely immersed in the settling fluid.

Between the settling tank which is moved up and down and the wall of the settlement tub which contains the settling tank there is a space filled with settling fluid. When the settling tank and the chute connected thereto move upwards, a certain negative pressure occurs in the space below the chute with the consequence that settling fluid is sucked out of an adjacent following or downstream settlement tub into the space between the two settling tanks. This stream of fluid also carries particles of material with it out of the settling tank and into the aforementioned space, resulting in the depositing of undesirable faulty material there. A further disadvantage is that considerable wear is produced by the faulty material being sucked through sealed gaps.

The object of the invention, therefore, is to construct a percussion jig of the type referred to, but which avoids the undesirable suction and pressure conditions described above which occu below the chute during the upward and downward movement of the settling tank.

SUMMARY OF THE INVENTION

According to the invention the chute which serves to introduce the material to be separated and the chute which serves to discharge the light material from the settling tank are each divided into a plurality of individual chute segments arranged adjacent to one another over the breadth of the settling tank, with clearances between them which facilitate a free equalisation of levels of the settling fluid during the movement of the settling tank. In this way the level of the settling fluid in the interior of the settling tank and in the space between the settling tank and the wall of the settlement tub (i.e., between the settling tank and the settling tub) during the upward and downward movement of the settling tank can be freely equalised. As a result the suction referred to above occurring below the chute and the disadvantages resulting therefrom, particularly the carrying along of faulty material into the space and wear caused by this faulty material, are avoided.

In a percussion jig according to the invention seals between the vertically movable settling tank and the stationary wall of the settlement tub can be dispensed with, which also eliminates the problem of wear of these seals.

The ratio between the total breadth of all the individual chute segments to the breadth of the settling tank is advantageously between 0.25 and 0.75, preferably between 0.4 and 0.6, and particularly 0.5.

According to the invention the ratio of the breadth of an individual chute segment to the clearance between adjacent individual chute segments is advantageously between 0.5 and 1.5, preferably between 0.9 and 1.1, and particularly 1.

For the treatment of fine-grained material it is advantageous according to the invention if the bases of the individual chute segments are impermeable to the settling fluid. This has the advantage that no material can fall through the bases of the chute segments and pass through the spaces between the settling tank and the wall of the settlement tub to the bottom of the tub and contaminate the separated products.

By contrast, for the treatment of material which flows poorly it is advantageous for the bases of the individual chute segments to be permeable to the settling fluid. In this way the material located in the chute is loosened, which facilitates a better flow of the material in the chute.

During the upward movement of the settling tank the side walls of the individual chute segments advantageously extend above the surface of the settling fluid. If the upper walls of the individual chute segments are impermeable to the settling fluid then they are advantageously constructed roof-like so as to promote flow in such a way that when the settling tank is moving upwards they produce less resistance to flow. In such a construction the settling fluid above the individual chute segments is displaced during the upward movement of the settling tank with less resistance to flow, and the displaced fluid does not lead to a horizontal flow into the individual chutes.

On the other hand, particularly for coarse material with poor flow properties, it is advantageous if the upper walls of the individual chute segments are permeable to the settling fluid. During the movement of the settling tank, particularly the lifting movement from the bottom to the top, the fluid can flow freely vertically through the chutes, especially if the bases of the individual chute segments are also permeable to the settling fluid.

The side wall of the settling tank advantageously extend above the surface of the settling fluid.

THE DRAWINGS

One embodiment of the invention is illustrated schematically in the drawings, in which:

FIG. 1 is a vertical section through a percussion jig having two settlement tubs;

FIG. 2 is a top plan view of the percussion jig;

FIG. 3 is a sectional view taken on the line 3—3 of FIG. 1.

DETAILED DESCRIPTION

The illustrated percussion jig contains two settlement tubs 1 and 2, each with a settling tank 3, 4 which can be moved upwards and downwards therein. The settling tanks 3, 4 can be moved upwards and downwards by operating rods 5, 6 coupled to drive means (not shown) as is conventional.

The settling tanks 3, 4 are not completely immersed in the settling fluid; their side walls extend above the surface 7 of the settling fluid (cf. the upper edge 3*a* and 4*a* of the respective tanks.

A separating screen 8, 9 is located in each of the settling tanks 3, 4. Valves 12 and 13 respectively which can be actuated by operating rods 10, 11 respectively are also provided for discharging the material on the separating screens 8 and 9 respectively.

A stationary first (delivery) chute 14 is connected to the settling tank 3 for the introduction thereto of the material to be separated. This chute is divided, as is best shown in FIG. 2, into a plurality of individual chute segments 14*a*–14*f* which are arranged adjacent to one another and distributed over the breadth B of the settling tank 3, so that between adjacent individual chute segments (e.g., 14*a*, 14*b*) there is in each case a clearance (e.g., 15) which serves for the free equalisation of levels of the settling fluid during the movements of the settling tank 3.

A second (transfer) chute 16 which is also divided into a plurality of individual chute segments 16*a*–16*f* arranged spaced from one another is also connected to the settling tank 3. These individual chute segments 16*a*–16*f* transfer the material from the settling tank 3 of the settlement tub 1 to the settling tank 4 of the following or downstream settlement tub 2. The clearances (e.g., 17) between the individual chute segments 16*a*–16*f* also facilitate an equalisation of levels of the settling fluid during the upward and downward movement of the settling tanks 3 and 4. The fluid displaced by the individual chute segments 16*a*–16*f* in the region of the spaces 18, 19 (between the settling tanks 3 and 4 and the wall 20) in particular can flow through the clearances 17.

The settling tank 4 is connected to a discharge chute 21 which is also divided into a plurality of individual chute segments 21*a*–21*f* arranged spaced from one another. During the upward and downward movement of the settling tank 4 the spaces (e.g., 22) between these individual chute segments 21*a*–21*f* facilitate a free flow of the fluid in the space 23 between the settling tank 4 and the wall 24.

The individual chute segments have a uniform breadth b; the distance between adjacent individual chute segments (i.e., the breadth of the clearance) also is uniform and is designated by d.

The ratio of the total breadth b of all the individual chute segments (e.g., 14*a*–14*f*) of a chute (e.g., 14) to the breadth B of the settling tank is between about 0.25 and 0.75, and preferably 0.5. The ratio of the breadth b of an individual chute segment to the clearance d between adjacent individual chute segments is between about 0.5 and 1.5 and preferably 1.

In the construction of the chutes 16 and 21 shown in full lines in FIG. 1 the chutes are completely submerged below the surface 7 of the settling fluid during the upward and downward movement of the settling tanks 3, 4. Broken lines (outlines 16*a*, 21*a*) in FIG. 1 indicate the alternative wherein the side walls of the chutes 16 and 21 extend through the surface of the settling fluid 7 either constantly or at least during the upward movement of the settling tank.

As has been indicated above, the bases of the individual chute segments may be either permeable or impermeable depending upon whether the jig is used for the separation of fine-grained or coarse materials. The same observation applies to the roof-like tops of such segments.

We claim:

1. In a percussion jig having at least one settlement tub containing settling fluid and within which is a vertically reciprocable tank at least partially immersed in the settling fluid, means for reciprocating said tank, a first chute for delivering material to be separated into said tank, and a second chute communicating with said settling tank and movable therewith for discharging relatively light material from the settling tank, the improvement wherein the two chutes are each divided into a plurality of individual chute segments arranged adjacent to one another over the breadth of the settling tank, each of said segments being spaced apart by a clearance of such breadth as to provide equalisation of the levels of the settling fluid during vertical movements of said tank.

2. A percussion jig according to claim 1 wherein the ratio of the total breadth of all the individual chute segments of at least one of said chutes to the breadth of the settling tank is between about 0.25 and 0.75.

3. A percussion jig according to claim 2 wherein said ratio is between about 0.4 and 0.6.

4. A percussion jig according to claim 2 wherein said ratio is about 0.5.

5. A percussion jig according to claim 1 wherein the ratio of the breadth of an individual chute segment to the clearance between adjacent individual chute segments is between about 0.5 and 1.5.

6. A percussion jig according to claim 5 wherein said ratio is between about 0.9 and 1.1.

7. A percussion jig according to claim 5 wherein said ratio is about 1.0.

8. A percussion jig according to claim 1 wherein each individual chute segment has a base impermeable to the settling fluid.

9. A percussion jig according to claim 1 wherein each individual chute has a base permeable to the settling fluid.

10. A percussion jig according to claim 1 wherein each of the individual chute segments has side walls which project above the surface of the settling fluid.

11. A percussion jig according to claim 1 wherein each of the individual chute segments has upper, roof-like walls impermeable to the settling fluid to produce a lesser resistance to fluid flow during upward movement of the settling tank.

12. A percussion jig according to claim 1 wherein each of the individual chute segments has an upper wall permeable to the settling fluid.

13. A percussion jig according to claim 1 wherein said settling tank has sides that extend above the surface of the settling fluid.

14. A percussion jig according to claim 1 wherein each individual chute segment has upper and lower wall impermeable to the settling fluid.

15. A percussion jig according to claim 1 wherein each individual chute segment has upper and lower walls permeable to the settling fluid.

* * * * *